US005299797A

United States Patent [19]

Ricciardi

[11] Patent Number: 5,299,797

[45] Date of Patent: Apr. 5, 1994

[54] SEGMENTED DOCUMENT TRANSPORT SECTION HAVING ACCELERATED TAKE-AWAY BELTS

[75] Inventor: Mario Ricciardi, Glenview, Ill.

[73] Assignee: Bell & Howell Phillipsburg Company, Evanston, Ill.

[21] Appl. No.: 935,778

[22] Filed: Aug. 28, 1992

[51] Int. Cl.[5] ..... B65H 1/02

[52] U.S. Cl. ..... 271/150; 271/270

[58] Field of Search ..... 271/150, 151, 31.1, 271/126, 270, 275

[56] References Cited

U.S. PATENT DOCUMENTS

| | | | |
|---|---|---|---|
| 2,361,907 | 11/1944 | Baker | 271/151 X |
| 2,639,025 | 5/1953 | Schmitt | 198/184 |
| 2,646,899 | 7/1953 | Stover | 214/17 |
| 3,285,389 | 11/1966 | Kaplan | 271/150 X |
| 4,621,798 | 11/1986 | Akens | 271/150 X |
| 4,884,797 | 12/1989 | Svyatsky | 271/150 X |
| 4,955,596 | 9/1990 | Ricciardi | 271/110 |
| 5,101,966 | 4/1992 | Lapeyre | 198/803.14 |
| 5,141,219 | 8/1992 | Watts et al. | 271/203 |
| 5,161,792 | 11/1992 | Wood | 271/151 |

*Primary Examiner*—H. Grant Skaggs

*Attorney, Agent, or Firm*—Millen, White, Zelano, & Branigan

[57] ABSTRACT

A transport section for a document-handling machine includes a pair of horizontally-oriented feed belts which act in conjunction with segment flaps on a segmented, vertically-oriented feed belt to deliver groupings of mail items in a feeding direction. A set of horizontally-oriented take-away belts receives documents from the horizontally-oriented-feed belts and transports them at an accelerated speed with respect to the horizontally-oriented feed belts. The accelerated speed of the take-away belts is used to compensate for the acceleration of each given document by the tips of the flaps as the flaps round the corner at the end of their run.

6 Claims, 3 Drawing Sheets

SEGMENTED DOCUMENT TRANSPORT SECTION HAVING ACCELERATED TAKE-AWAY BELTS

BACKGROUND OF THE INVENTION

1. Field of the Invention

The invention relates to document transport devices for use in document handling machines, and particularly to document transport devices utilizing a conveyor belt for transporting documents on-edge in a vertically-oriented, upright position.

2. Related Art

Document handling machines which convey mail on-edge, that is, where the plane of the mail item is vertical while it is conveyed by a horizontal belt, are well-known. A document handling machine of this type is taught in commonly-assigned U.S. Pat. No. 4,955,596, the entire disclosure of which is incorporated herein by reference. Generally, such machines convey a series of envelopes between stations which perform various operations, such as bar-code reading, bar-code printing, and sorting.

Because mail items are delivered to the machine in stacks, a feeder which singulates the stacks of mail into a series of end-to-end, vertically oriented, individual items is required. This conversion step often uses a ninety-degree change of direction in the envelope path, which is accomplished by a series of feed rollers oriented so as to feed in a direction perpendicular to the path of incoming stacks of documents. However, any deceleration of a document at the perpendicular feeding area, due, for example, to momentary sticking or jamming of one or more documents, is transferred to documents upstream of the perpendicular feeding area. The reason for this transfer is that the close proximity of documents causes back-pressures to travel in a direction reverse to the feeding direction of the incoming documents. At high machine throughput speeds, the extent of these back-pressures is great. As a result, inconsistency in the amount of pressure applied to the documents and in the spacing between documents causes jamming and other undesirable effects.

SUMMARY

The use of a conveyor belt having lugs or flaps for segmenting a stream of documents in document handling machines would isolate documents upstream from a feeder from back-pressures that build up due to sticking or jamming at the feeder. However, the use of these segmented conveyors makes take-away of the documents at the end of the conveyor belt difficult at high machine throughput speeds. The reason for this is that the outer area of the flaps will accelerate when the lugs round the corner at the end of a belt system, and thus the document packet being pushed along by a particular flap will accelerate as that flap rounds the corner at an end portion of the conveyor belt, and such acceleration causes documents being pushed by the flaps also to be turned by them as those flaps round the corner at the end of their travel. To compensate for that acceleration, a set of take-away belts is provided for removing the documents from the segmented conveyor at a speed which is accelerated with respect to that of the segmented conveyor.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
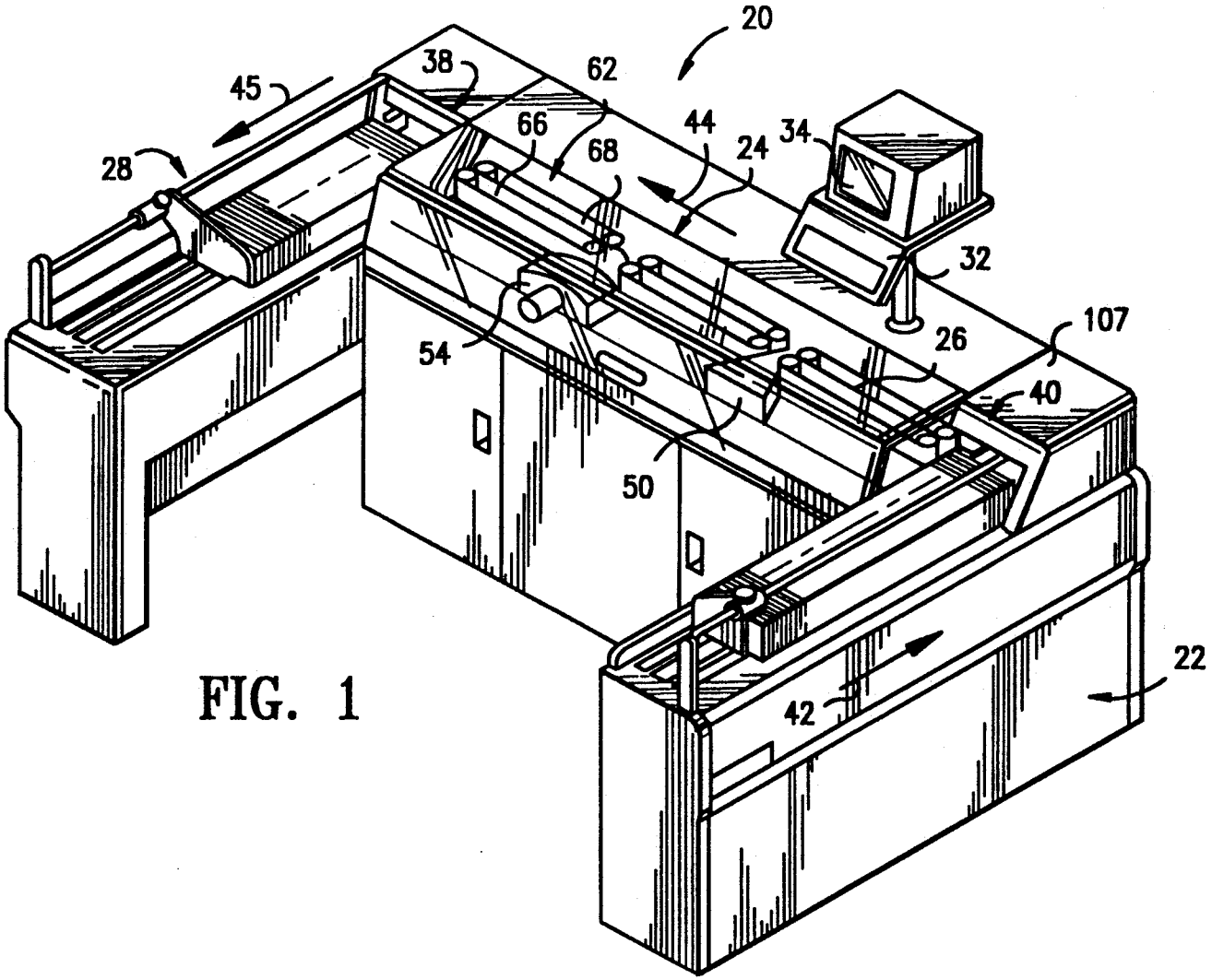
FIG. 1 is a schematic view of a document handling machine of the prior art.

FIG. 1 shows a system 20 for processing flat articles, such as envelopes. Examples of such processing include, but are not limited to, sorting, labeling with a bar code, and inserting documents in envelopes. System 20 comprises an input transport section 22; a processing/-transport section 24 wherein flat articles, such as envelopes, are transported along a processing path 26; and a discharge transport section comprising a stacker 38 and a storage section 28. The processing system 20, hereinafter also referred to as an envelope processing system 20, also includes a keyboard 32; a monitor 34; and a printer 54. Envelopes are delivered to input transport section 22 in upright stacks and are fed on-edge from the input transport section 22 through a ninety-degree angle to the processing/transport section 24 via feeder section 40. The envelopes travel on-edge and one-at-a-time through the processing/transport section 24. From the processing/transport section 24 the envelopes are loaded onto the storage section 28 by stacker 38.

The direction of envelope travel on the input transport section 22 is shown by arrow 42; the direction of envelope travel from section 22 onto the processing/-transport section 24 as propelled by the feeder section 40 is shown by the arrow 44; and the direction of envelope travel into the storage section 28 is shown by arrow 45. The direction of envelope travel on the processing/transport section 24 is perpendicular to the direction of envelope travel on the input transport section 22 and the storage section 28.

In the particular embodiment under discussion, the processing/transport section 24 directs envelopes along the processing path 26 which has reader means so; a detector photocell (not shown); and bar code printer means 54 positioned therealong. It should be understood that in other embodiments of the invention, other and/or additional functions can be performed along the processing path 26.

Envelopes are transported on-edge through the processing/transport section 24 in the direction of arrow 44 by a transport system 62 which includes a series of revolving horizontal belts (not shown) and a series of revolving vertical belts, including front vertical belts 66 and back vertical belts. The bottom edges of envelopes ride on the horizontal belts 64, while the front sidewalls and back sidewalls of the envelopes are contacted by the belts 66 and 68, respectively.

Figure 2:
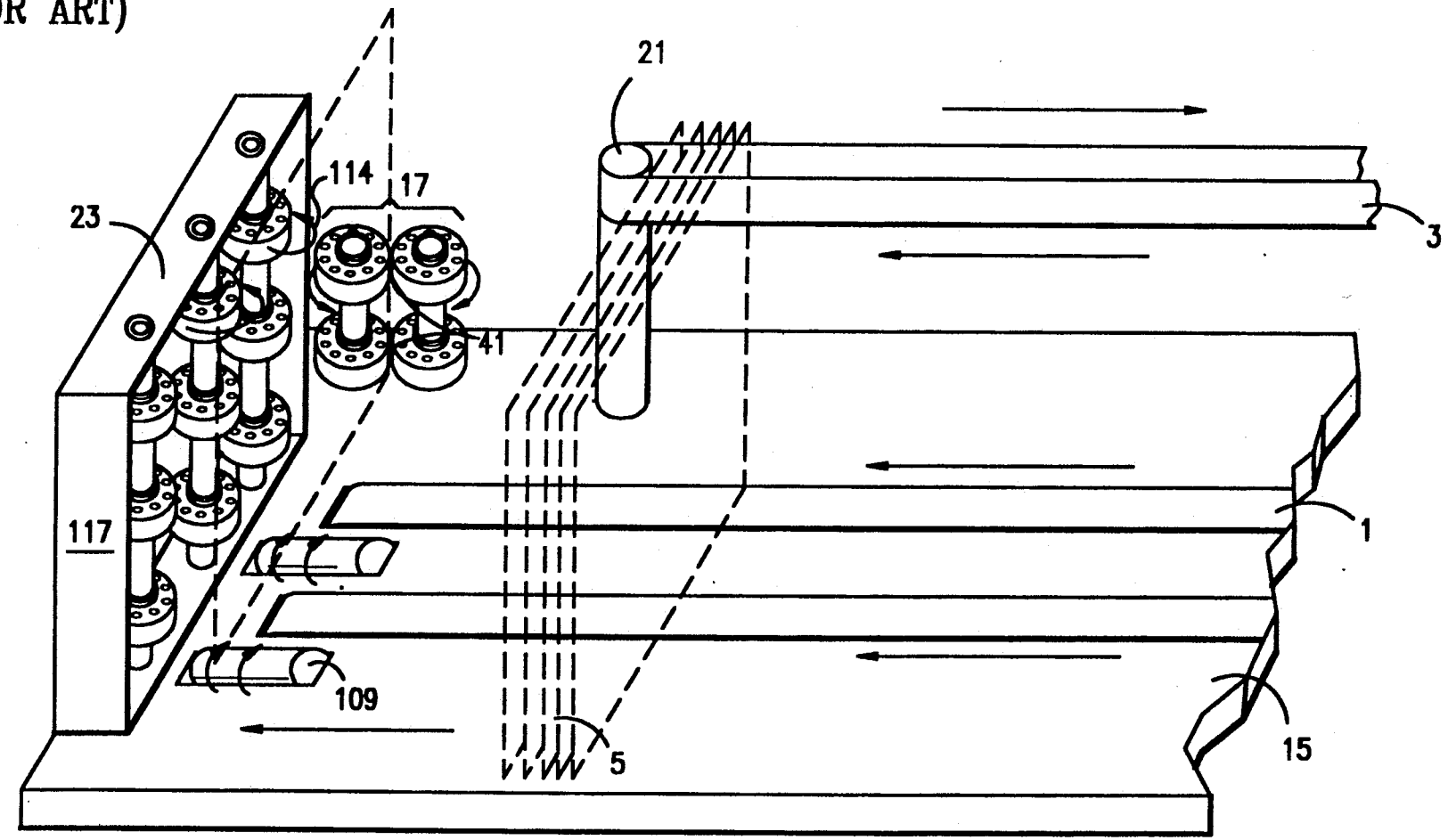
FIG. 2 (PRIOR ART)
FIG. 2 is a schematic view of an input transport section of the prior art.

FIG. 2 shows the input transport section according to the prior art. The input transport section comprises a transport table 15 for transporting documents such as envelopes. Transport table 15 comprises a pair of horizontally-oriented feed belts 1 which act in conjunction with a vertically-oriented feed belt 3 to deliver mail items 5 in a first feeding direction to a pair of rollers 109. The rollers 109 are rotating in a clockwise direction when viewed from the right in FIG. 1 so as to feed in a second feeding direction, perpendicular to the first feeding direction, into nip 41 of feeder 17, which is schematically illustrated here as a set of nip rollers. Feeder 17 could also take on other known forms, such as that of a singulator plate pressed against a drive belt running in the second feeding direction; such a feeder is described in more detail in commonly-assigned copending application Ser. No. 07/797,402, filed Nov. 25, 1991, which is incorporated herein by reference. A set of assist rollers 23 may be provided for applying additional force to documents in the second feeding direction. The assist rollers 23 are encased in a housing 117 and are driven by a drive means (not shown) so as to rotate in the direction indicated by arrow 114.

The feeder 17 is operative to convert the stream of overlapping documents into a series of single, closely-spaced documents which are suitable for individual processing. As discussed above with reference to FIG. 1, examples of such processing include, but are not limited to, sorting, labeling, and inserting the documents in envelopes or the like.

Figure 3:
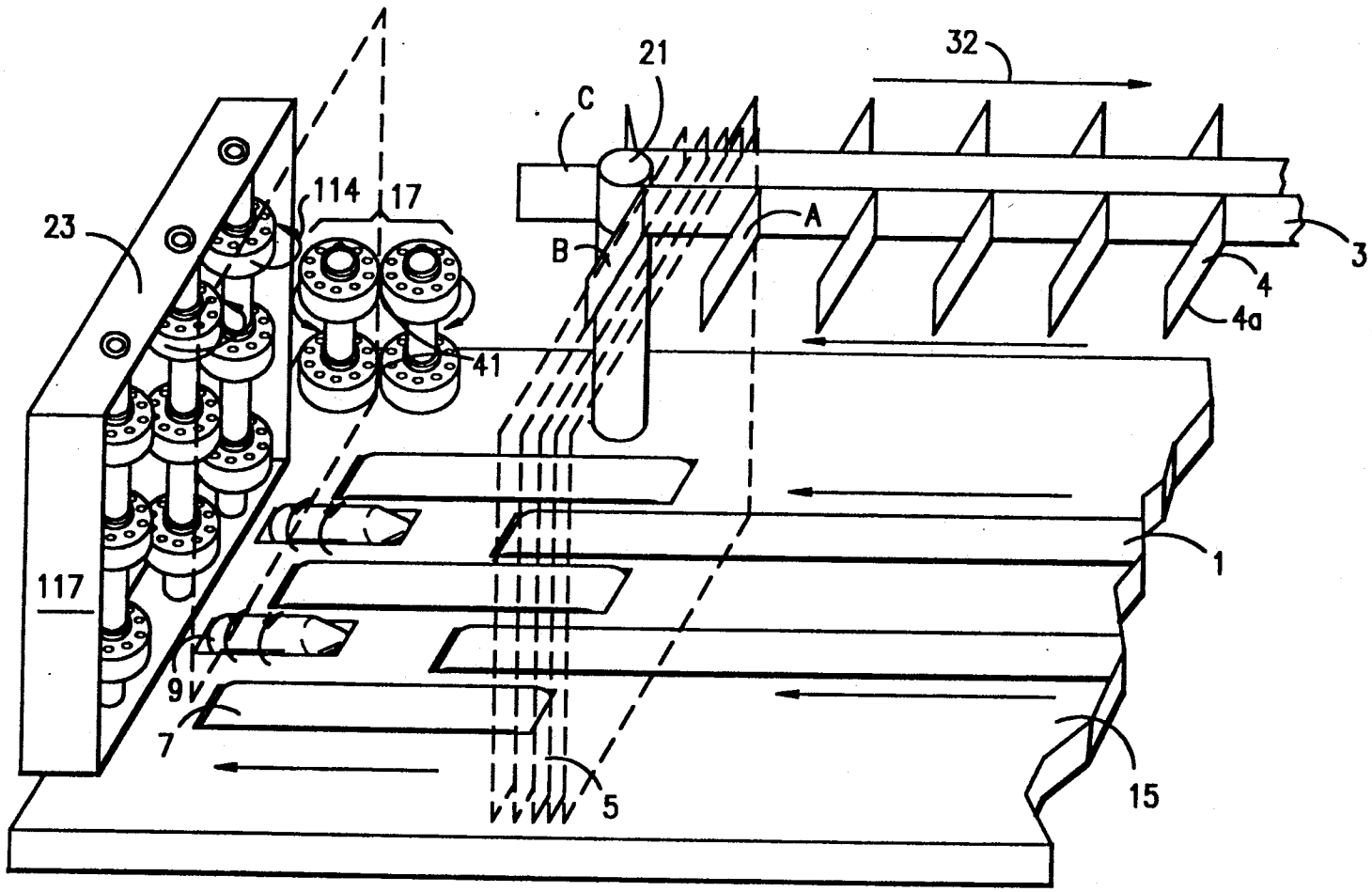
FIG. 3 is a schematic view of the input transport section according to an embodiment of the invention.

FIG. 3 shows an input transport section according to the invention. The input transport section comprises a transport table 15 for transporting documents such as envelopes. Transport table 15 comprises a pair of horizontally-oriented feed belts I which act in conjunction with segment flaps 4 on a segmented, vertically-oriented feed belt 3 to deliver groupings of mail items 5 in a first feeding direction to one or more take-away belts 7 moving at an accelerated speed with reference to feed belts 1. The feed belt 3 moves in the direction as designated by arrow 3*a* and around a cylinder post 21; and the tips 4*a* move at a higher linear velocity as they round the post 6. Hence, the accelerated speed of belts 7 is used to match or exceed the acceleration of each given document by the tips 4*a* of segment flaps 4 which push the documents at a greater speed, for example, between positions B and C than between positions A and B. Moreover, absent the use of accelerated take-away belts, a document would tend to turn along with its associated flap as that flap moves from point B to point C. As is shown in FIG. 3, feed belt 3 comprises an endless belt having two substantially parallel lengths lying in a substantially horizontal plane, while take-away belts 7 each comprise an endless belt having substantially parallel lengths lying in a substantially vertical plane, i.e., in a plane substantially orthogonal to the plane of feed belt 3.

The take-away belts 7 continue to move the mail in the first feeding direction, toward a pair of tapered rollers 9. The tapered rollers 9 are rotating in a clockwise direction when viewed from the right in FIG. 1 so as to feed in a second feeding direction, perpendicular to the first feeding direction, into nip 41 of feeder 17, the operation of which is discussed above with respect to FIG. 2.

A further advantage to the use of accelerated take-away belts 7 is that the difference in velocity between the speed of feed belt 3 and take-away belts 7 causes a spatial separation between successive documents after they have passed onto the take-away belts 7. This spatial separation amounts to a decrease in a decrease in compactness of a stack of envelopes being fed, and thereby results in greater ease-of -shingling of the envelopes at the tapered rollers 9.

While the invention has been particularly shown and described with reference to a preferred embodiment thereof, it will be understood by those skilled in the art that various changes in form and details may be made therein without departing from the spirit and scope of the invention. For example, the horizontally disposed conveyor belts as shown in FIG. 1 could be replaced by a series of rollers or other known transport means.

The embodiments of the invention in which an exclusive property or privilege is claimed are defined as follows:

1. An input transport section for a document handling machine, comprising:

a first transport means movable in a first feeding direction and having a plurality of segments along its length for conveying in a series of groups of documents a plurality of documents placed in contact with said first transport means, said first transport means comprising an endless conveyor having two lengths which lie parallel in a first plane; and a second transport means movable in said first feeding direction at an accelerated speed with respect to said first transport means and disposed at an end portion of said first transport means for removably conveying said groups of documents from said first transport means, said second transport means comprising an endless conveyor having two lengths which lie parallel in a second plane, said second plane being substantially orthogonal to said first plane.

2. The input transport section according to claim 1, wherein said first transport means comprises a first conveyor belt.

3. The input transport section according to claim 2, wherein said plurality of segments are defined by a plurality of flaps attached to said first conveyor belt and extending outwardly from a vertical plane thereof.

4. The input transport section according to claim 2, wherein said second transport means comprises a second conveyor belt.

5. The input transport section according to claim 4, wherein said first conveyor belt is oriented so as to be substantially perpendicular with respect to said second conveyor belt.

6. A device for processing flat documents, comprising:

an input transport section further comprising a first conveyor belt movable in a first feeding direction and having a plurality of segments defined by flaps, attached along the length of said first conveyor belt for conveying in a series of groups of documents a plurality of documents placed in contact with said first transport means; and a second conveyor belt movable in said first feeding direction at an accelerated speed with respect to said first conveyor belt and disposed at an end portion of said first conveyor belt for removably conveying said groups of documents from said first conveyor belt; at least one roller disposed at an end portion of said conveyor belt and oriented so as to have a feeding direction substantially perpendicular to said first feeding direction for receiving said flat documents and for imparting to said flat documents a velocity in a second feeding direction substantially perpendicular to said first feeding direction, whereby said flat documents are caused to be transmitted in a shingled form;

a feeder for accepting said flat documents in said shingled form and for delivering said documents in said second feeding direction and for separating said flat documents in said shingled form into a stream of single documents;

a processing/transport section comprising a second transport means for accepting said stream of single documents from said feeder and for transporting said documents past at least one processing station, said at least one processing station performing on said stream of single documents one or more of the processing steps of sorting, labeling, or inserting the documents in envelopes; and a discharge transport section comprising a stacker and a storage section, said stacker accepting said single documents from said processing/transport section and delivering said documents to said storage section in a stacked form.

* * * * *